United States Patent [19]

Chu et al.

[11] 4,049,504

[45] Sept. 20, 1977

[54] METHOD OF PRODUCING LITHOGRAPHIC PRINTING PLATES

[75] Inventors: Simon L. Chu, Dobbs Ferry; Eugene Golda, Monsey, both of N.Y.

[73] Assignee: Polychrome Corporation, Yonkers, N.Y.

[21] Appl. No.: 660,569

[22] Filed: Feb. 23, 1976

[51] Int. Cl.[2] ..... C25D 11/08; C25D 11/12

[52] U.S. Cl. ..... 204/38 A; 204/58

[58] Field of Search ..... 204/17, 58, 38 A

[56] References Cited

U.S. PATENT DOCUMENTS

| | | | |
|---|---|---|---|
| 2,703,781 | 3/1955 | Hesch | 204/58 |
| 3,594,289 | 7/1971 | Watkinson et al. | 204/58 |
| 3,891,516 | 6/1975 | Chu | 204/33 |
| 3,915,811 | 10/1975 | Tremmel et al. | 204/58 |
| 3,940,321 | 2/1976 | Adams | 204/58 |

OTHER PUBLICATIONS

Proceedings, *Am. Electroplaters' Society*, June 18–23, 1961, pp. 52–55.

*Primary Examiner*—T. M. Tufariello

[57] ABSTRACT

In the production of lithographic printing plates, the method of anodizing the surface of an aluminum web substrate which comprises subjecting said web to an anodization treatment in an electrolyte comprised of a combination of sulfuric acid and phosphoric acid, and thereafter applying a lithographically acceptable photosensitive coating to the web to obtain a presensitized lithographic printing plate.

10 Claims, No Drawings

METHOD OF PRODUCING LITHOGRAPHIC PRINTING PLATES

The method of production and use of presensitized lithographic printing plates is now well known and is widely practiced in the printing arts. Usually, a metal substrate web, most often aluminum sheeting, has applied to it a photosensitive material which after exposure of an image with light can be developed to yield a printable plate. In recent times, production of the presensitized offset lithographic plates has been improved in various ways to provide a better product. One of the ways which is well known to impart desirable characteristics of this presentized lithographic plate is by treatment of the metal substrate web whereby the surface or surfaces of the web are anodized. The anodization of the surface of the metal, usually aluminum, web imparts to the resultant printing plate surface a hardness which is beneficial for longer press life of the plate and an improvement in the water carrying properties, which gives better printing properties.

There are a number of issued U.S. Patents which clearly teach the desirability and results of anodization of the metal substrates in the production of lithographic printing plates. Among those patents which may be mentioned in this regard are U.S. Pat. No. 3,891,516; 3,181,461 and 3,300,309.

It is well known that in the production of lithographic printing plates, the most preferable method of anodizing the surface of the metal substrate involves first the preparation of the surface by the roughening thereof. This roughening procedure is known in the art as "graining", and can be accomplished by either mechanical, electrolytic, or chemical means. Thus, the surface of the metal substrate of the printing plate may be grained by treatment thereof with brushes, a wet slurry mass of abrasives or sandblasting, among other such like means as known in the art to provide a grained surface on the metal web substrate.

The grained surface of the metal substrate may then by anodized by treatment in an electrolyte solution employing electric current. This anodization treatment may be carried out in either direct or alternating current, depending upon the method of anodization being practiced by the skilled worker. The most preferred mode of preparing the final lithographic printing plates thus involves first graining the surface of the metal substrate, anodizing the thus grained surface, and then applying the desired photosensitive lithographically acceptable coating thereto to yield the desired plate. The photosensitive coating may be applied directly to the anodized surface, or there may first be applied an interlayer coating, which gives better bonding of the photosensitive coating, to the anodized surface. This method of producing lithographic printing plates is well known as taught in U.S. Pat. No. 3,181,461, and provides a most desirable product having improved characteristics such as superior mechanical adhesion of the printing surface, abrasion resistance to wear, and water holding properties of the printing plate. These characteristics allow the production of a printing plate which has a long press life and gives high fidelity reproduction. Heretofore, the anodization of lithographic plate has always been carried out in single electrolyte solutions. By this it is meant to denote that the anodization procedure has always been carried out in the presence of a single electrolyte. The electrolytes which are presently most commonly employed for such purposes are sulfuric acid or phosphoric acid. Both of these anodization electrolytes suffer from certain disadvantages which must presently be overcome in the production of lithographic printing plates. The most important deficiency of these electrolytes is that they impart undesirable visual characteristics to the surface which has been anodized therewith. For example, when a sulfuric acid electrolyte is employed in anodization of the metal web a gray color is imparted to the anodized surface. Upon development of the lithographic printing plate produced from the sulfuric acid anodized metal web, this gray background interferes with the visualization of the developed image on the plate, making it difficult for the printer to assess the quality of the plate prior to its actual use on the printing press.

When a phosphoric acid electrolyte is employed in the anodization of the metal web, a dark smut is formed on the anodized surface of the metal web which also interferes with the visualization of the printing image of the developed printing plates produced therefrom. In addition, when a phosphoric acid electrolyte is employed in the anodization of the surface of the metal web, the resultant anodized surface is relatively soft thus resulting in a much shorter press life for the resultant printing plate. In order to overcome these disadvantages, it has been found necessary to perform additional treatments of the metal web surface when anodizing with either sulfuric acid or phosphoric acid electrolytes. Heretofore, the darkened color of the surface of the metal substrate could be avoided by additional processing steps, such as an acid or alkali etch of the grained surface of the substrate. However, in some instances, if care is not exercised this acid or alkali etching process could effectively remove or impair the grained surface to which it was applied, thus resulting in a printing plate having inferior bonding qualities and poor printing properties.

It has now been unexpectedly found that there is a method whereby the surface of a metal substrate web, preferably an aluminum web, can be anodized in a single process while at the same time avoiding the disadvantages experienced with other anodizing procedures. More particularly, this invention relates to a novel process of anodizing the surface of aluminum sheet substrates employed in the production of lithographic printing plates, which comprises subjecting said aluminum sheet substrates to anodization with an electric current in the presence of an electrolyte solution comprised of a combination of sulfuric acid and phosphoric acid.

The metal substrate web employed in the practice of this invention may be any metal web which is capable of use in the production of lithographic printing plates. In the practice of this invention it is preferable to employ those metal webs which are usually subjected to anodization treatment for such purposes, and in its most preferable embodiment, this invention envisions the use of an aluminum sheet web for such purposes, as is well known in the art. In the practice of this invention satisfactory results may be obtained where the surface of the aluminum sheet web is grained prior to anodization, or where it is not so grained. However, most satisfactory results are obtained where a grained aluminum sheet web is treated in accordance with this invention. This graining is accomplished in any manner known to the art to provide the type of roughened surface which is desired to be employed in the production of the desired lithographic printing plate. Thus, the methods for graining the surfaces of aluminum sheets such as those taught in U.S. Pat. No. 3,891,516, granted June 24, 1975, may be employed in the treatment of the aluminum sheets of this invention.

The aluminum sheet, whether grained or not, is then subjected to anodization by treatment with an electric current under anodizing conditions in an electrolyte solution comprised of a combination of the mineral acids of this invention, i.e. sulfuric acid and phosphoric acid. The electric current which may be employed for anodization of the aluminum sheet in the practice of this invention may be either direct or alternating current as is known to the skilled worker. The current density and voltage of the electric current employed in this invention may be equivalent to those employed in the known and currently practiced anodizing methods, and more specifically, it has been found that satisfactory results are obtained herein under the following conditions:

| | Alternating Current [amps/sq. ft. of web surface being treated] | Direct Current [amps.sq. ft. of web surface being treated] |
|---|---|---|
| Current Density: | 10 - 150 | 10 - 150 |

The conditions under which the instant invention may be practiced to yield satisfactory results are roughly equivalent to those conditions of anodization well known to and currently practiced by the skilled worker. Thus, the temperature of the electrolyte solutions may range from 25° to 50° C. during the anodization treatment, and the anodization treatment may be applied for a period of from 15 seconds to 3 minutes depending upon the degree of anodization desired. Most preferably, the length of the anodization treatment of the aluminum sheet hereunder should not be less than 0.5 minutes or in excess of 1.0 minutes to achieve the results required.

The aqueous electrolyte solution which is employed in the practice of this invention is an essential element in its successful practice. The aqueous electrolyte solution employed in the practice of this invention must contain a concentration of the acids of this invention of from 5 to 40% by weight. Most preferably, the electrolyte solution will have a total acid concentration of from 15 to 25% by weight. The acids which have been found to give satisfactory results in the practice of this invention are sulfuric acid and phosphoric acid which must be combined and incorporated into the single aqueous electrolyte solution. It has been found that successful results are obtained when from 1 to 3 parts by weight of sulfuric acid are combined with from 3 to 1 parts by weight of the phosphoric acid. The combined acids may then be diluted with water to provide the final electrolyte solution to be employed in this invention. Most preferably, in the practice of this invention, to prepare the electrolyte solution, 1 to 1.5 parts by weight of sulfuric acid are combined with from 1 to 1.5 parts by weight phosphoric acid, which is then diluted down to the desired concentration by the addition of water, to yield the final electrolyte solution.

After completion of the anodization treatment of this invention the resultant anodized aluminum sheet possesses a surface having the desired hardness and water carrying properties for use in the production of lithographic printing plates and surprisingly also has a lightened or whitened color which permits easy visualization of the resultant imaged surface of the exposed and developed printing plate prepared therefrom.

The thus anodized aluminum sheet may be further treated to yield the desired finished lithographic printing plate by the application thereon of a satisfactory photosensitive composition useful for such purposes. If an intermediate bonding material, such as that taught by U.S. Pat. No. 3,181,461, is desired it may be applied prior to the application of the photosensitive coating. The photosensitive coating which may be applied may be one well known in the art for such purposes, such as those taught by U.S. Pat. No. 3,891,516.

The invention may be further illustrated by the following Examples:

EXAMPLE 1

An aluminum sheet which has been grained by treatment in accordance with the teachings of U.S. Pat. No. 3,891,516 is anodized under the following conditions:

An electrolyte solution comprised of one part of 15% sulfuric acid and one part of 15% phosphoric acid was prepared. The grained aluminum sheet was immersed in the electrolyte and as a direct current source was applied at a voltage of 10 volts to provide a current density of 90 amps/square foot of aluminum sheet surface for a period of 30 seconds at a temperature of 130° F. The resultant aluminum sheet surface was whitish gray in color and gave a surface reflectance reading of 48 when analyzed by photovolt reflectometer. The anodized surface was tested by the standard ASTM method and it was determined that 100 mg/square foot of anodized surface had been put down by this procedure.

EXAMPLE 2

The anodizing procedure of Example 1 was repeated except that the electrolyte solution contained an equivalent amount of sulfuric acid only as the electrolyte. The resultant anodized surface was dark gray in color and gave a surface reflectance of 25 when analyzed by photovolt reflectometer.

EXAMPLE 3

The anodizing procedure of Example 1 was repeated except that the electrolyte solution contained an equivalent amount of phosphoric acid only as the electrolyte. The resultant anodized surface was covered with a dark smut-like substance which was brushed off, yielding a gray surface which gave a surface reflectance reading of 30 when analyzed by photovolt reflectometer. In addition, the resultant surface was relatively soft and could be easily scratched.

EXAMPLE 4

The procedure of Example 1 was followed, except that the acid concentrations of the electrolyte solution were varied. The concentrations of and results obtained with the different electrolyte solutions are set forth in Table A below:

Table A

| Solution | 10% H2 SO4* | 20% H3 P04* | Color | Reflectance | Anodic Wt.** |
|---|---|---|---|---|---|
| 1 | 1 | 2 | Grayish White | 54 | 52 |
| 2 | 2 | 1 | Grayish White | 49 | 72.5 |

*parts by weight
**mg/square foot

EXAMPLE 6

The procedure of Example 2 was repeated except that an alternating current was employed for anodizing to give a current density of 90 amps/square foot for 30 seconds. The resultant anodized surface was dark gray and gave a reflectance reading of 32.

EXAMPLE 7

The procedure of Example 3 was repeated except that an alternating current source was employed. The resultant anodized surface was a dark gray in appearance and had a surface reflectance reading of 29 when analyzed.

EXAMPLE 8

The procedure of Example 1 was followed except that the aluminum sheet was first grained by either brushing, sandblasting and electrochemical treatment, with equivalent results being obtained.

The invention may be variously otherwise embodied within the scope of the appended claims.

What is claimed is:

1. A method of producing a lithographic printing plate which comprises applying a lithographically acceptable photosensitive coating to an aluminum sheet, at least one surface of which sheet has been anodized by treatment thereof with an electric current under anodizing conditions in an aqueous electrolyte comprised of a combination of sulfuric and phosphoric acids as the electrolyte.

2. The lithographic printing plate produced according to the method of claim 1.

3. The method of claim 1 wherein the surface of said aluminum sheet has been grained prior to anodizing.

4. The method of claim 1 wherein an intermediate bonding layer is applied to the anodized surface of the aluminum sheet prior to the application of the photosensitive coating.

5. The method of claim 1 wherein the current density of said electric current is from about 10 to about 150 amps/sq.ft.

6. A method of producing a lithographic printing plate which comprises applying a lithographically acceptable photosensitive coating to at least one grained surface of an aluminum sheet, which sheet has been anodized with an electric current having a current density of from about 10 to about 150 amps/sq.ft., under anodizing conditions in an aqueous electrolyte comprised of a combination of sulfuric acid and phosphoric acid.

7. The lithographic printing plate produced according to the method of claim 6.

8. The method of claim 6 wherein an intermediate bonding layer is applied to the anodized surface of the grained aluminum sheet prior to the application of the photosensitive coating.

9. The method of claim 6 wherein the concentration of sulfuric acid in the electrolyte is from about 10% to about 30%.

10. A method of producing a lithographic printing plate which comprises applying a photosensitive, lithographically acceptable coating to at least one grained surface of an aluminum sheet, said surface having been anodized for from about 0.25 to about 3.0 minutes in an aqueous electrolytic bath maintained at a temperature of from about 25 to 50° C, containing from about 5% to about 40% acid by weight wherein said acid consists essentially of from about 1 to 1.5 parts of sulfuric acid and from about 1 to 1.5 parts phosphoric acid, with a current density of from about 10 to about 150 amps/sq.ft.

* * * * *